US008475191B2

(12) United States Patent
Schafmeister

(10) Patent No.: US 8,475,191 B2
(45) Date of Patent: Jul. 2, 2013

(54) ELECTRICAL TERMINAL HAVING A CONSTANTLY VISIBLE LABELING FIELD

(75) Inventor: Arndt Schafmeister, Doerentrup (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 196 days.

(21) Appl. No.: 13/060,760

(22) PCT Filed: Aug. 27, 2009

(86) PCT No.: PCT/EP2009/006237

§ 371 (c)(1),
(2), (4) Date: Feb. 25, 2011

(87) PCT Pub. No.: WO2010/022955

PCT Pub. Date: Mar. 4, 2010

(65) Prior Publication Data

US 2011/0151699 A1 Jun. 23, 2011

(30) Foreign Application Priority Data

Aug. 27, 2008 (DE) ..... 10 2008 039 868
Mar. 26, 2009 (DE) ..... 10 2009 014 397

(51) Int. Cl.
*H01R 11/22* (2006.01)

(52) U.S. Cl.
USPC ..... 439/266; 439/489; 439/835

(58) Field of Classification Search
USPC ..... 439/266, 441, 440, 488, 489, 835
See application file for complete search history.

(56) References Cited

U.S. PATENT DOCUMENTS

| | | | | |
|---|---|---|---|---|
| 4,759,726 | A * | 7/1988 | Naylor et al. | 439/441 |
| 4,846,722 | A | 7/1989 | Heng | |
| 5,915,991 | A * | 6/1999 | Roman | 439/441 |
| 6,146,187 | A * | 11/2000 | Pallai | 439/441 |
| 6,146,217 | A * | 11/2000 | Osada | 439/835 |
| 6,261,120 | B1 * | 7/2001 | Beege et al. | 439/441 |
| 6,712,649 | B2 * | 3/2004 | Mano et al. | 439/835 |
| 6,851,967 | B2 * | 2/2005 | Miyoshi et al. | 439/441 |
| 8,113,858 | B1 * | 2/2012 | Chiang | 439/188 |
| 8,129,641 | B2 * | 3/2012 | Majewski et al. | 200/335 |
| 2003/0066673 | A1 | 4/2003 | Doutaz | |
| 2007/0207662 | A1 | 9/2007 | Germani | |
| 2010/0081316 | A1 * | 4/2010 | Eppe et al. | 439/441 |
| 2011/0223795 | A1 * | 9/2011 | Schafmeister | 439/370 |

FOREIGN PATENT DOCUMENTS

| | | | |
|---|---|---|---|
| DE | 2503091 | A1 | 7/1976 |
| DE | 3830442 | A1 | 3/1989 |
| DE | 19613557 | A1 | 6/1997 |

(Continued)

OTHER PUBLICATIONS

Search Report for International Application No. PCT/EP2009/006237, Dec. 11, 2009.

*Primary Examiner* — Hae Moon Hyeon
(74) *Attorney, Agent, or Firm* — Leydig, Voit & Mayer, Ltd.

(57) ABSTRACT

An electric connection terminal includes a housing having at least one conductor insertion opening. A clamping spring is disposed in the housing. A metal part is disposed in the housing. An actuating element is disposed in the housing and has a handle configured to move the actuating element into an open position and a closed position so as to open and close the connection terminal. A labeling field identifying the connection terminal is disposed so as to be visible to a user at all times.

5 Claims, 7 Drawing Sheets

FOREIGN PATENT DOCUMENTS

| | | | |
|---|---|---|---|
| DE | 69703829 | T2 | 7/2001 |
| DE | 20313041 | U1 | 10/2003 |
| DE | 10237701 | A1 | 2/2004 |
| DE | 4408985 | B4 | 7/2005 |
| DE | 102007009082 | A1 | 9/2007 |
| DE | 202007001701 | U1 | 6/2008 |
| DE | 102007050936 | A1 | 5/2009 |
| EP | 0352347 | A1 | 1/1990 |
| EP | 1296413 | A1 | 3/2003 |
| WO | WO 9120110 | A1 | 12/1991 |

* cited by examiner

ELECTRICAL TERMINAL HAVING A CONSTANTLY VISIBLE LABELING FIELD

CROSS-REFERENCE TO PRIOR APPLICATIONS

This application is a U.S. National Phase application under 35 U.S.C. §371 of International Application No. PCT/EP2009/006237, filed on Aug. 27, 2009, and claims benefit to German Patent Application Nos. DE 10 2008 039 868.3, filed on Aug. 27, 2008, and DE 10 2009 014 397.1, filed on Mar. 26, 2009. The International Application was published in German on Mar. 4, 2010 as WO 2010/022955 under PCT Article 21(2).

FIELD

The invention relates to an electric connection terminal.

BACKGROUND

Electric connection terminals are known in a wide variety of types. In this context, the connection terminals can be configured as a so-called printed terminal, for instance, to connect an electric conductor to a printed circuit board, or as a modular terminal to make a connection to another conductor.

Loop-shaped clamping springs, so-called tension spring terminals, as well as U-shaped or V-shaped clamping springs, so-called leg springs, are employed as clamping springs, into which rigid conductors or conductors fitted with a core end sleeve can be inserted directly without the clamping point first having to be opened with a tool. In the case of the prior-art loop-shaped tension springs the conductor that is to be connected is pulled against a bus bar by means of the clamping leg. In contrast to this, in the case of U-shaped or V-shaped clamping springs, the conductor that is to be connected is pressed against the bus bar or against a section of the metal part.

In order to actuate the tension spring terminal, an actuation tool, for example, a screwdriver, is inserted into an actuation shaft for purposes of opening the terminal. In this process, the tip of the screwdriver tensions the tension spring, as a result of which the clamping point is opened. A conductor that is to be connected can be inserted into the clamping leg through a cutout and, once the actuation tool has been removed, it is clamped by the lower edge of the cutout against a bus bar connected to the tension spring. In this context, connection terminals are also known with which an actuating element is mounted in the housing for purposes of facilitating the opening and closing of the tension spring terminal. The actuating element can be configured in the form of a lever that is arranged on an outer surface of the housing that surrounds the clamping spring, so that users can easily access and operate the actuating element. In order for users to easily recognize which connection terminal and thus which actuating element they should operate, the connection terminal normally has a marking or label on the surface of the actuating element that faces away from the housing. The label can be configured, for example, in such a way that it allows the connection terminal to be matched to the conductor that is to be connected. A drawback here, however, is that users cannot read the label when the actuating element is in its open position since the actuating element is pivoted upwards when it is in this position, and consequently, the surface of the actuating element is pivoted out of the user's view.

SUMMARY

In an embodiment, the present invention provides an electric connection terminal including a housing having at least one conductor insertion opening. A clamping spring is disposed in the housing. A metal part is disposed in the housing. An actuating element is disposed in the housing and has a handle configured to move the actuating element into an open position and a closed position so as to open and close the connection terminal. A labeling field identifying the connection terminal is disposed so as to be visible to a user at all times.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
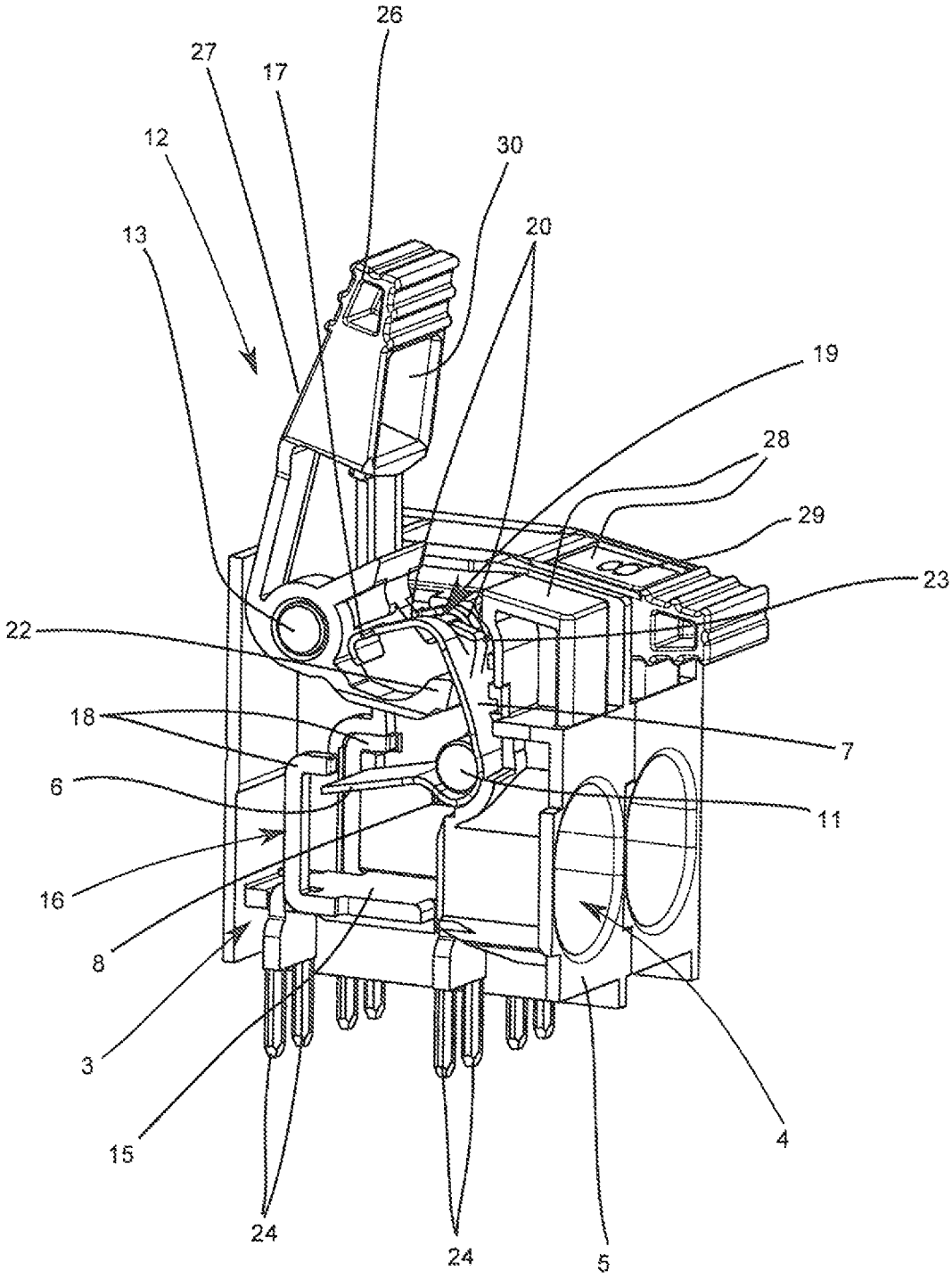
FIG. 1—a perspective view of two electric connection terminals according to an embodiment of the present invention arranged next to each other, whereby one connection terminal is in an open position while the other connection terminal is in a closed position.

It is an aspect of the present invention to provide an electric connection terminal that is configured in such a way that the connection terminals can easily be matched up at all times.

The electric connection terminal according to an embodiment of the present invention has a clamping spring, a metal part, and a housing that accommodates the clamping spring and the metal part, and that has at least one conductor-insertion opening, whereby an actuating element installed in the housing is provided in order to open and close the connection terminal, whereby said actuating element has a handle by means of which the actuating element can be moved into the open and closed positions. According to an embodiment of the present invention, a labeling field is provided for purposes of labeling the connection terminal, and this field is arranged in such a way that it is visible to a user at all times.

The labeling field is preferably a flat surface that is arranged on the connection terminal and that can be labeled by color coding or by one or more characters or symbols. This labeling field is arranged on the connection terminal in such a manner that the labeling field and thus the labeling are visible and legible to a user at all times. The term "at all times," as used in herein, means that the labeling field is visible to the user even when the connection terminal has been installed, for example, in a series of several connection terminals and/or when the connection terminal is present in its installed state, for instance, when it has been installed in a switching cabinet. Moreover, the labeling field is also visible when the actuating element is opened or closed by means of the actuating element according to the meaning of "at all times." The labeling field is not covered by the actuating element at any time. The labeling field can preferably be labeled directly on its surface, without a need for additional marking tags or sleeves for such marking tags.

According to a preferred embodiment of the invention, the labeling field is situated on an outer surface of the housing. The outer surface of the housing is the surface of the housing that faces away from the clamping spring arranged in the housing. Since the labeling field is arranged on an outer surface of the housing, there is no need for an additional component for the labeling field.

Preferably, the labeling field is arranged on the outer surface of the housing with which the handle of the actuating element is in contact when the actuating element is in its closed position. The handle of the actuating element is preferably arranged on the side surface of the housing that is freely accessible and visible to the user, even when the connection terminal has been installed. Since the labeling field is likewise provided on the outer surface on which the actuating element is provided, it is easy for users to operate the connection terminal and, at a glance, a user can match the connection terminal to the conductor that is to be connected and, at the same time, the connection terminal can be operated by means of the actuating element. Consequently, this dispenses with the need to first tediously search for the appropriate labeling of the connection terminal before the connection terminal can be operated by means of the actuating element.

According to another preferred embodiment of the invention, the actuating element has a cutout that is configured in such a way that, when the actuating element is in its closed position, the labeling field fits into the cutout. The cutout is preferably configured as a through-opening and is arranged on the handle of the actuating element, which is in contact with the outer surface of the housing. The cutout preferably has the shape of the labeling field so that the labeling field can fit precisely into the cutout. In this manner, the labeling field is visible to the user at all times, even when the actuating element is closed and also when the actuating element is open.

According to another advantageous embodiment of the invention, the labeling field can also be labeled by means of an ink jet printer, a plotter or a thermal-transfer method. In this manner, the labeling field can be labeled easily and quickly.

Referring to FIGS. 1 to 7, an electric connection terminal 1 includes a clamping spring 2 and a metal part 3. Both the clamping spring 2 and the metal part 3 can be configured as simple punched and bent parts, although it is not necessary for the clamping spring 2 and the metal part 3 to be made of the same material. The clamping spring 2 and the metal part 3 are arranged together in a housing 5 that has a conductor-insertion opening 4 and that is made of an insulating material, especially plastic.

Figure 2:
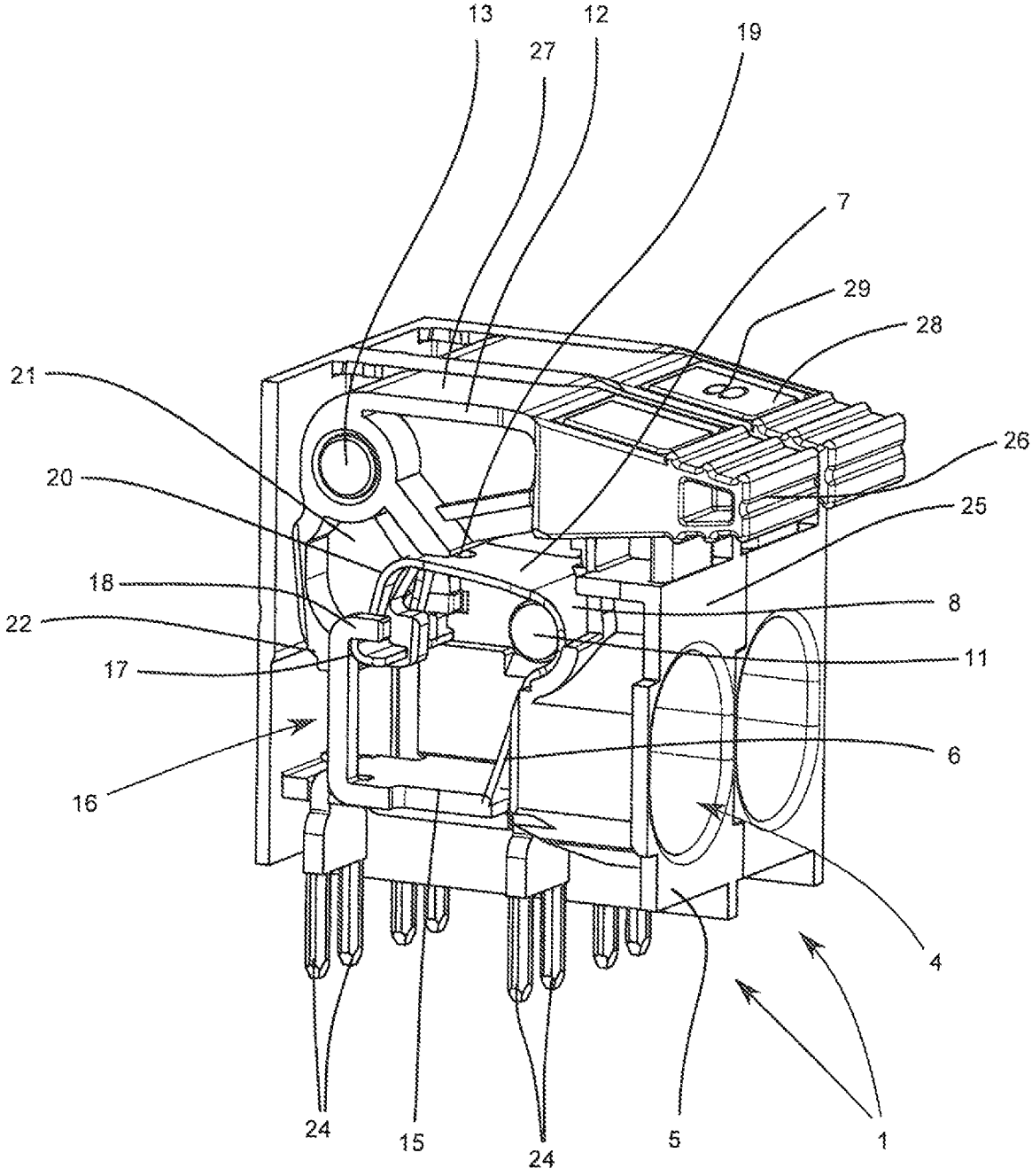
FIG. 2—a perspective view of the two connection terminals according to FIG. 1, both in a closed position.
Figure 3:
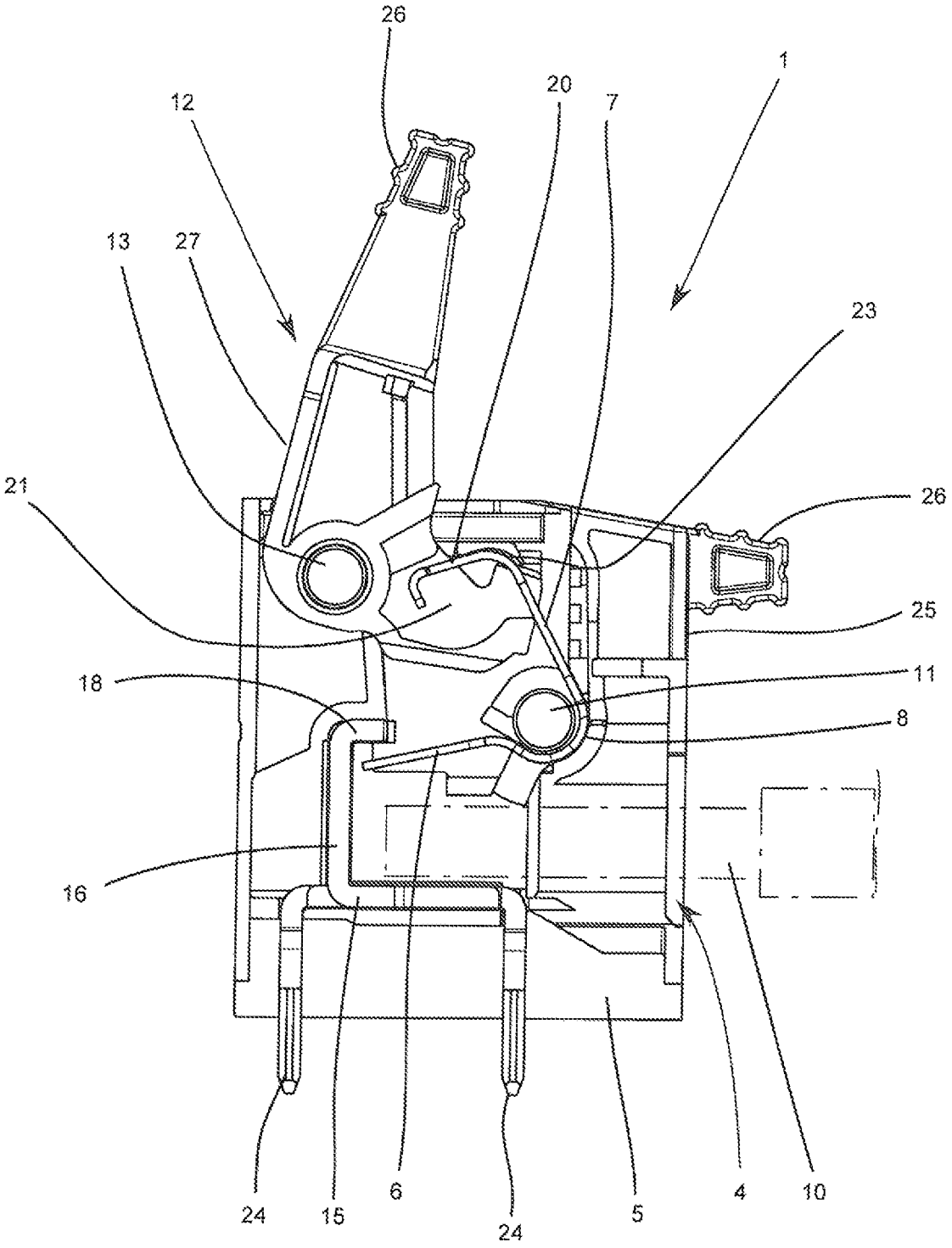
FIG. 3—a side view of an electric connection terminal in a completely open position in accordance with an embodiment of the present invention.

The clamping spring 2 has a clamping leg 6, an actuating leg 7 and a back 8 that joins the two legs 6, 7 to each other, whereby the clamping leg 6, together with the metal part 3, forms a clamping point 9 for an insulated conductor 10 that is to be connected (see FIG. 3). A bearing pivot pin 11 is shaped onto the housing 5 and the clamping spring 2 is pivotably mounted onto said bearing pivot pin in such a way that the clamping spring 2 can be pivoted from a first (open) position (see FIGS. 1 and 3) into a second (closed) position (see FIGS. 2, 5 and 6). In the first position of the clamping spring 2, an insulated electric conductor 10 that has been inserted through the conductor-insertion opening 4 can be inserted into the clamping point 9 without a need for the clamping leg 6 to be deflected against its spring force or against the spring force of the clamping spring 2. In the second position of the clamping spring 2, the electric conductor 10 is conductively clamped between the end of the clamping leg 6 and the metal part 3, whereby the clamping leg 6 has been deflected out of its resting position.

Figure 4:
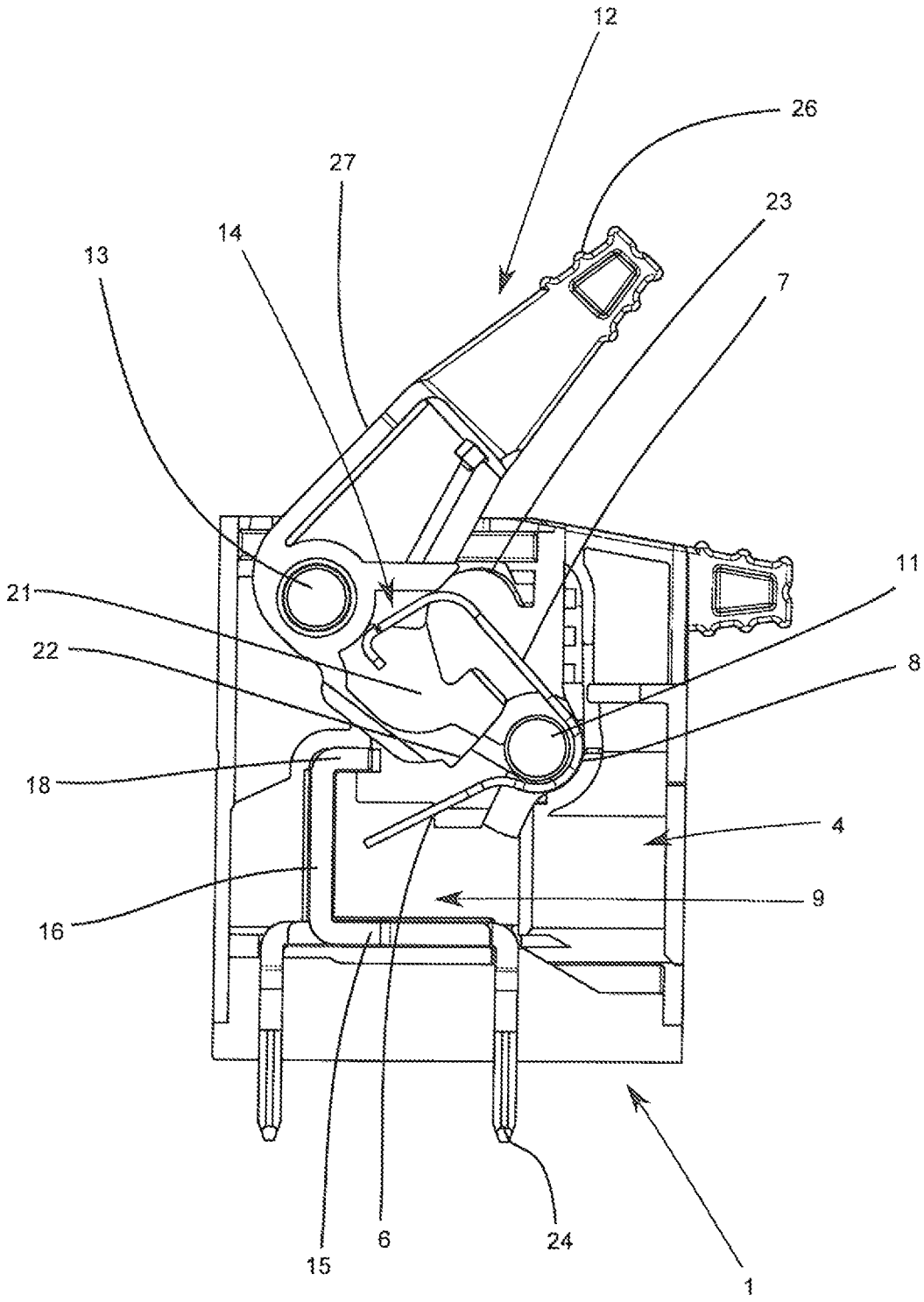
FIG. 4—the connection terminal according to FIG. 3, when pivoted into a second, closed position.
Figure 5:
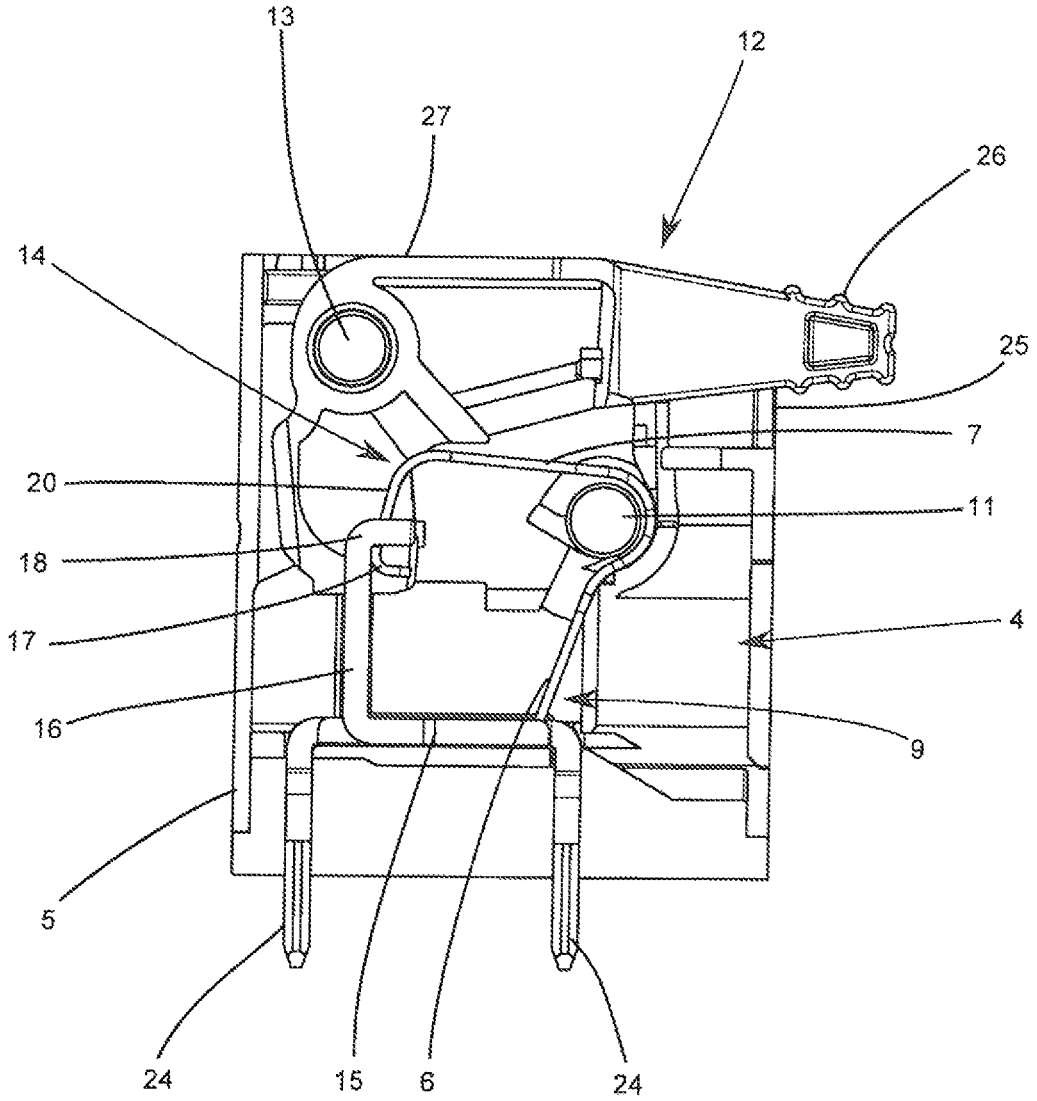
FIG. 5—the connection terminal according to FIG. 3, in the closed position.
Figure 6:
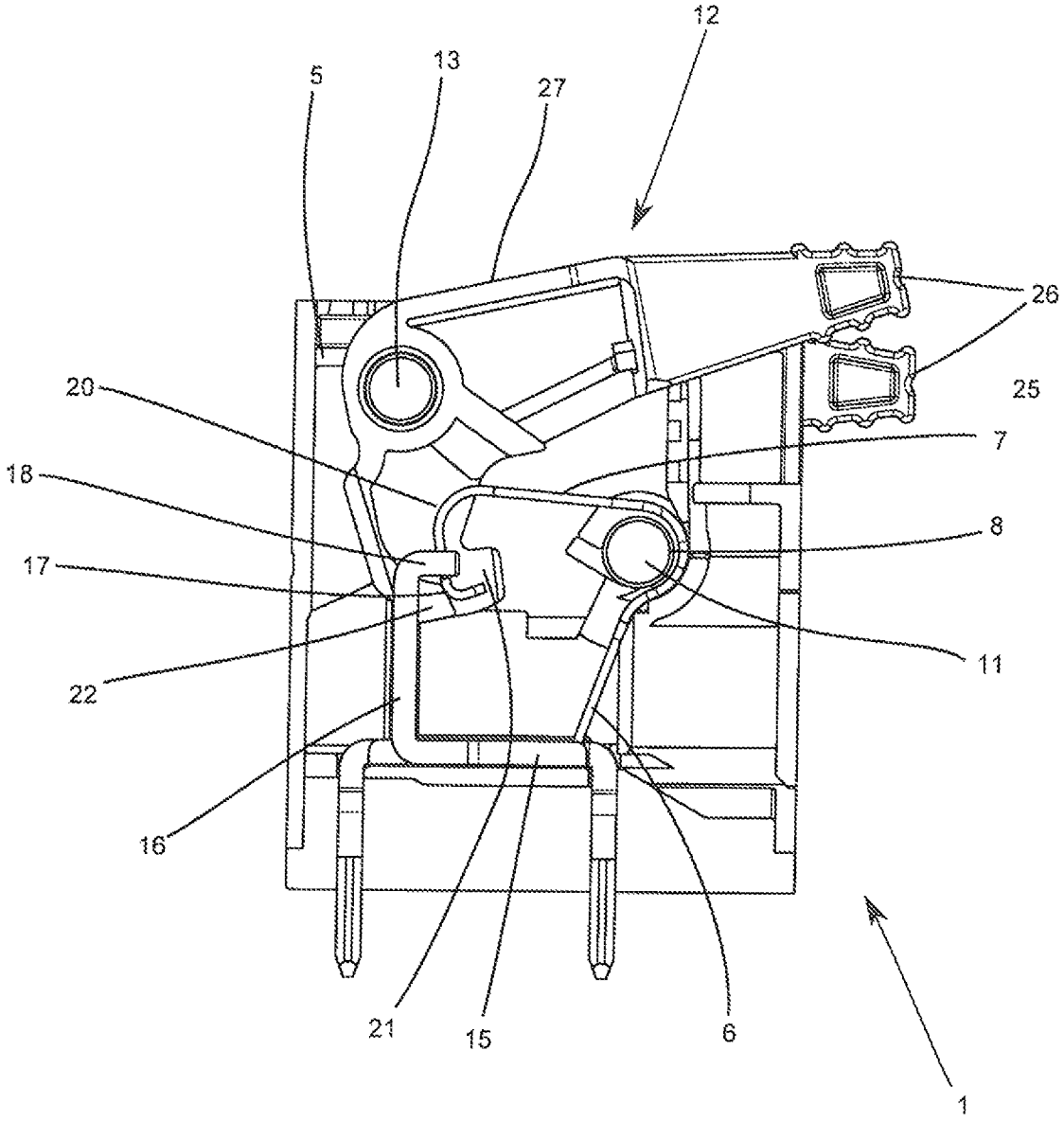
FIG. 6—the connection terminal according to FIG. 3, at a beginning of the opening procedure.
Figure 7:
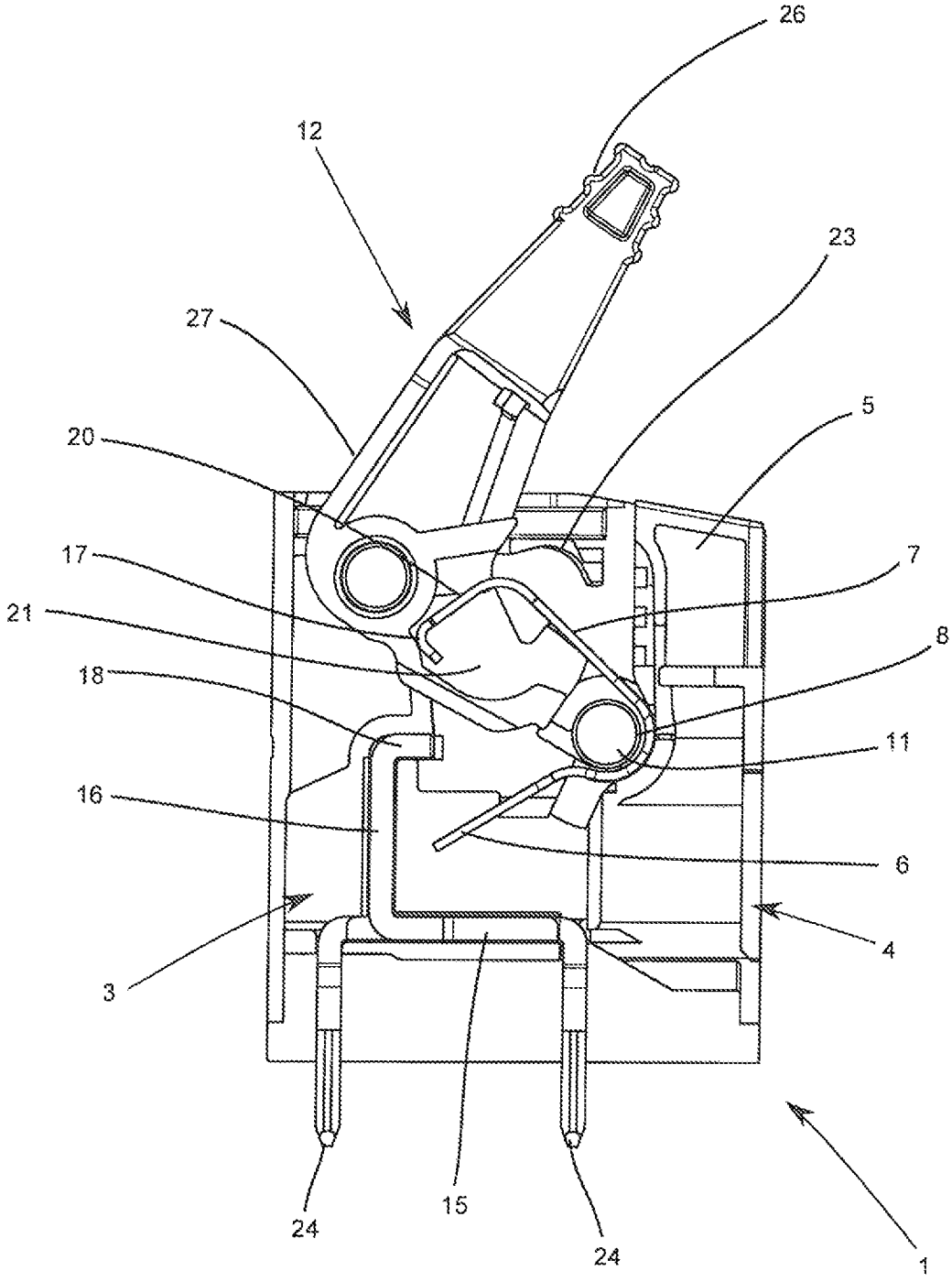
FIG. 7—the connection terminal according to FIG. 3, in an almost completely open position.

The electric connection terminal 1 can be actuated in a particularly user-friendly manner in that an actuating element 12 located in the housing 5 is pivotably mounted on a second conductor pivot pin 13. If the actuating element 12 is pivoted out of the first (open) position shown in FIG. 1 into its second (closed) position shown in FIG. 2, then the pivoting of the actuating element 12 causes the clamping spring 2 to be pivoted from its first position into its second position. Therefore, the electric connection terminal 1 can be closed by pressing down the pivotably mounted actuating element 12, and opened—once again—by pivoting the actuating element 12 in the opposite direction. FIGS. 3 to 5 show the closing procedure of the clamping spring 2 at three consecutive points in time, while FIGS. 6 and 7 show the opening procedure at two points in time. In the arrangement and orientation of the electric connection terminal 1 shown in FIGS. 1 to 7, the actuating element 12 has to be pivoted clockwise in order to close and counterclockwise in order to open, in other words, the actuating element 12 is pressed down in order to be closed and pivoted upwards in order to be opened. In order to make it easier for users to open and close the actuating element 12, the latter has a handle 27 that is configured in the form of a lever.

In order to mark or label the connection terminal 1, a labeling field 28 is provided which is arranged in such a way that the labeling field 28 is visible to users at all times. The labeling field 28 is preferably a flat surface that is arranged on the connection terminal 1 and that can be labeled by color coding or by one or more characters or symbols, that is to say, directly on the surface of the labeling field. This labeling field 28 is arranged on the connection terminal 1 in such a manner that the labeling field 28 and thus the labeling 29 are visible and legible to users at all times. By way of an example, FIGS. 1 and 2 show such labeling 29 on the labeling field 28

The labeling field 28 is arranged on an outer surface of the housing 5. The outer surface of the housing 5 is the surface of the housing 5 that faces away from the clamping spring 2 arranged in the housing 5. Here, the labeling field 28 is arranged on an outer surface of the housing 5 with which the handle 27 of the actuating element 12 comes into contact when the actuating element 12 is in its closed position. The actuating element 12 also has a cutout 30 that is configured in such a way that, when the actuating element 12 is in its closed position, the labeling field 28 fits into the cutout 30. The cutout 30 is preferably configured as a through-opening and it is arranged on the handle 27 of the actuating element 12 which is in contact with the outer surface of the housing 5. The cutout 30 preferably has the shape of the labeling field 28 so that the labeling field 28 can fit precisely into the cutout 30. In this manner, the labeling field 28 is visible to users at all times, both when the actuating element 12 is closed as well as when the actuating element 12 is open. In the area of the labeling field 28, the housing 5 is preferably configured in the form of a latching tab so that the latter can fit into the cutout 30 of the handle 27 of the actuating element 12. The labeling field 28 can be labeled by means of an ink jet printer, a plotter or a thermal-transfer method. In this manner, the labeling field 28 can be labeled easily and quickly.

As can be seen particularly in FIGS. 2 and 5, the clamping spring 2 is locked in its second position, so that the clamping spring 2 does not pivot back in the direction of the first position because of its pivoting arrangement and because of its spring force after an electric conductor 10 has been connected. For this purpose, on its end that is far away from the clamping leg 6, the actuating leg 7 of the clamping spring 2 has a holding section 14 that is bent in the direction of the clamping leg 6. Corresponding to that, aside from a clamping section 15, the metal part 3 also has a holding section 16 bent in the direction of the actuating leg 7. In the embodiment of the connection terminal 1 shown in FIGS. 1 to 7, the latching between the holding section 14 of the actuating leg 7 and the holding section 16 of the metal part 3 is achieved in that, in each case, two projections 17 that protrude laterally outwards are present on the holding section 14 of the actuating leg 7, and the holding section 16 of the metal part 3 has two separate bent latching ends 18. In the latched state of the clamping spring 2 according to FIG. 2, the projections 17 are latched under the latching ends 18 so that the clamping spring 2 is kept in its closed position and cannot pivot back into its open position.

As can be seen especially in FIGS. 1 and 2, the holding section 14 of the actuating leg 7 has two holding legs 20 that are separated from each other by a slit 19, whereby one of each of the two projections 17 is formed on each of the two holding legs 20. Since two separate holding legs 20 are formed, the two holding legs 20 can more easily be deflected when the clamping spring 2 latches in the second position. Moreover, the ends of the two holding legs 20 are bent inwards, that is to say, in the direction of the clamping leg 6, so that the holding legs 20 do not tilt on the latching ends 18 when the actuating element 12 presses the actuating leg 7 down.

In order to open the clamping spring 2 and in order to facilitate the pivoting of the clamping spring 2 out of the second position into the first position, the actuating element 12 has an actuating wall 21 and two unlocking sections 22 formed laterally next to the actuating wall 21. The actuating wall 21 extends in the plane of the slit 19 formed in the holding section 14 of the actuating leg 7, so that when the clamping spring 2 is pivoted out of the closed position and into the open position, the actuating wall 21 can sink into the slit 19. When the clamping spring 2 is pivoted out of the closed position and into the open position, as shown in FIGS. 6 and 7, the two unlocking sections 22 first press against the two holding legs 20 of the holding section 14, as a result of which the latching between the projections 17 and the latching ends 18 is released.

When a conductor 10 is inserted into the electric connection terminal 1 so that the clamping leg 6 is deflected against the spring force of the clamping spring 2, then, after the latching has been released, the clamping spring 2 is itself first deflected into a partially open position due to the spring force, as shown in FIG. 7. In order to pivot the clamping spring 2 into the completely open position shown in FIGS. 1 and 3, the actuating element 12 has to be pivoted further upwards, in other words, counterclockwise in the orientation of the connection terminal 1 shown in FIGS. 3 to 7. In this process, the actuating wall 21 of the actuating element 12 slides through the slit 19 in the holding section 14 of the actuating leg 7 until the end of the actuating wall 21 makes contact with the actuating leg 7 from the inside, so that, when the actuating element 12 is pivoted further, the clamping spring 2 is also pivoted further into the completely open position. The completely open position of the clamping spring 2 is reached once the actuating leg 7 of the clamping spring 2 strikes a stop 23 formed in the housing 5. As a result, the completely open position of the clamping spring 2 is also easily visible to the technician.

The embodiment of the connection terminal 1 according to the present invention shown in the figures is a printed terminal for connecting a conductor 10 to a printed circuit board. For this purpose, the metal part 3 has several—in the embodiment shown, four—soldered connection prints 24 that are joined to the metal part 3 in one piece. Consequently, the metal part 3 can be manufactured as a simple punched or bent part made of a flat conductive material. By the same token, the clamping spring 2 can be made of a flat material and brought into the shape shown in the figures by means of punching and bending.

For purposes of simple and convenient handling of the actuating element 12, it has a handle section 26 that extends beyond the front face 25 of the housing 5. Therefore, as shown in FIGS. 3 to 5, the actuating element 12 can be easily pivoted from a first position into the second position, that is to say, into the closed position with one or two fingers, and as shown in FIGS. 6 and 7, and it can also be pivoted from the second position into the first position, that is to say, it can be opened, with one or two fingers.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 connection terminal
2 clamping spring
3 metal part
4 conductor-insertion opening
5 housing
6 clamping leg
7 actuating leg
8 back
9 clamping point
10 electric conductor
11 bearing pivot pin
12 actuating element
13 conductor pivot pin
14 holding section of the actuating leg
15 clamping section
16 holding section of the metal part
17 projection
18 latching ends
19 slit
20 holding leg
21 actuating wall
22 unlocking section
23 stop
24 soldered connection print
25 front face
26 handle section
27 handle
28 labeling field
29 labeling
30 cutout

The invention claimed is:

1. A series of electric connection terminals comprising:

at least two electric connection terminals disposed in a series, each electric connection terminal comprising:

a housing including at least one conductor insertion opening;

a clamping spring disposed in the housing;

a metal part disposed in the housing and configured to form, with the clamping spring, a clamping point for a conductor inserted through the insertion opening;

an actuating element disposed in the housing and having a handle configured to move the actuating element into an open position and a closed position so as to open and close the connection terminal by moving the clamping spring between open and closed positions; and a labeling field identifying the respective connection terminal and disposed so as to be visible to a user at all times.

2. The series of electric connection terminals according to claim 1, wherein the respective labeling field of each electric connection terminal is disposed on an outer surface of the respective housing that is visible to a user at all times.

3. The series of electric connection terminals according to claim 1, wherein the respective labeling field of each electric connection terminal includes at least one of an ink jet printer-formed labeling, a plotter-formed labeling and a thermal transfer-formed labeling.

4. An electric connection terminal comprising:

a housing including at least one conductor insertion opening;

a clamping spring disposed in the housing;

a metal part disposed in the housing and configured to form, with the clamping spring, a clamping point for a conductor inserted through the insertion opening;

an actuating element disposed in the housing and having a handle configured to move the actuating element into an open position and a closed position so as to open and close the connection terminal by moving the clamping spring between open and closed positions; and a labeling field identifying the connection terminal and disposed so as to be visible to a user at all times, the labeling field being disposed on an outer surface of the housing that is visible to a user at all times and at an area of the housing at which the handle of the actuating element is in contact when the actuating element is in the closed position.

5. An electric connection terminal comprising:

a housing including at least one conductor insertion opening;

a clamping spring disposed in the housing;

a metal part disposed in the housing and configured to form, with the clamping spring, a clamping point for a conductor inserted through the insertion opening;

an actuating element disposed in the housing and having a handle configured to move the actuating element into an open position and a closed position so as to open and close the connection terminal by moving the clamping spring between open and closed positions; and a labeling field identifying the connection terminal and disposed so as to be visible to a user at all times, wherein the actuating element includes a cutout configured to correspond to the labeling field such that the labeling field fits within the cutout when the actuating element is in the closed position.

* * * * *